US006712937B1

(12) United States Patent
Oechsle et al.

(10) Patent No.: US 6,712,937 B1
(45) Date of Patent: Mar. 30, 2004

(54) METHOD OF OPERATING A MACHINE FOR THE MANUFACTURE AND/OR REFINEMENT OF MATERIAL WEBS

(75) Inventors: Markus Oechsle, Bartholomä (DE); Frank Wegehaupt, Böhmenkirch (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/936,526

(22) PCT Filed: Mar. 13, 2000

(86) PCT No.: PCT/EP00/02198

§ 371 (c)(1),
(2), (4) Date: Dec. 5, 2001

(87) PCT Pub. No.: WO00/55421

PCT Pub. Date: Sep. 21, 2000

(30) Foreign Application Priority Data

Mar. 15, 1999 (DE) ..... 199 11 394

(51) Int. Cl.[7] ..... D21F 13/00

(52) U.S. Cl. ..... 162/198; 162/49; 162/263; 162/253; 162/254; 162/259; 162/DIG. 10; 34/48; 34/25; 34/30; 34/446; 73/73

(58) Field of Search ..... 162/49, 198, 263, 162/253, 259, DIG. 10; 34/48, 25, 30, 446, 447, 491; 73/73

(56) References Cited

U.S. PATENT DOCUMENTS

| | | | |
|---|---|---|---|
| 3,622,448 | A | 11/1971 | Adams et al. |
| 3,666,621 | A | 5/1972 | Adams |
| 3,731,520 | A | 5/1973 | Hickman et al. |
| 3,961,425 | A | 6/1976 | Swanson et al. |
| 4,204,337 | A | 5/1980 | Roos et al. |
| 4,614,044 | A | 9/1986 | Fiedler et al. |
| 5,071,514 | A | 12/1991 | Francis |
| 5,145,560 | A | 9/1992 | Grenlulnd |
| 5,298,122 | A | 3/1994 | Munch et al. |

(List continued on next page.)

FOREIGN PATENT DOCUMENTS

| | | |
|---|---|---|
| DE | 6900009 | 12/1968 |
| DE | 2926072 | 1/1980 |

(List continued on next page.)

OTHER PUBLICATIONS

Stenstrom et al., "Measurement of Reference Experimental Drying Data For The Multi–Cylinder Paper Dryer", pp. 1179–1186, (1999).

(List continued on next page.)

*Primary Examiner*—Peter Chin
*Assistant Examiner*—Mark Halpern
(74) *Attorney, Agent, or Firm*—Greenblum & Bernstein, P.L.C.

(57) ABSTRACT

System and method of operating a machine for manufacturing and/or refining a material web wherein the machine includes at least one machine section. The method includes arranging a plurality of measurement zones in series along a process direction and detecting data in a region of the at least one machine section via at least one measurement zone of the plurality of measurement zones. The data concerns at least one measured parameter relating to the manufacture or refinement of the material web. The system includes a plurality of measurement zones arranged in series along a process direction of the machine. At least one of the plurality of measurement zones is located in the at least one machine section. At least one measurement device for detecting data is located in at least one of the plurality of measurement zones. An evaluation unit is provided for evaluating the data.

57 Claims, 1 Drawing Sheet

U.S. PATENT DOCUMENTS

| | | | | |
|---|---|---|---|---|
| 5,358,606 | A | | 10/1994 | Makkonen |
| 5,377,428 | A | | 1/1995 | Clark |
| 5,540,000 | A | | 7/1996 | Rosenburgh et al. |
| 5,715,158 | A | | 2/1998 | Chen |
| 5,718,060 | A | | 2/1998 | Mori |
| 6,024,835 | A | * | 2/2000 | Fiore et al. ..... 162/198 |
| 6,099,620 | A | * | 8/2000 | Arno et al. ..... 95/121 |
| 6,171,642 | B1 | * | 1/2001 | Kustermann ..... 427/8 |
| 6,254,726 | B1 | | 7/2001 | Steiner et al. |

FOREIGN PATENT DOCUMENTS

| | | |
|---|---|---|
| DE | 3234598 | 3/1984 |
| DE | 3630561 | 3/1987 |
| DE | 3539354 | 5/1987 |
| DE | 3830308 | 4/1989 |
| DE | 3901378 | 8/1989 |
| DE | 19510009 | 9/1996 |
| DE | 19542448 | 5/1997 |
| DE | 19653477 | 6/1998 |
| DE | 19654345 | 6/1998 |
| DE | 19801140 | 7/1999 |
| DE | 19844927 | 4/2000 |
| GB | 1247891 | 9/1971 |
| GB | 1266221 | 3/1972 |
| WO | 9603616 | 2/1996 |
| WO | 99/04090 | 1/1999 |

OTHER PUBLICATIONS

Goertz: "Neue Beispiele für die Effizienz von Trockenpartieuntersuchungen" Das Papier, No. 12, 1995, pp. 771–775, XP000907079.

TAPPI Proceedings 1992 Engineering Conference, p. 629–638 and 639–654.

"Pulp & Paper Canada", 98:12(1997), p 111–113.

* cited by examiner

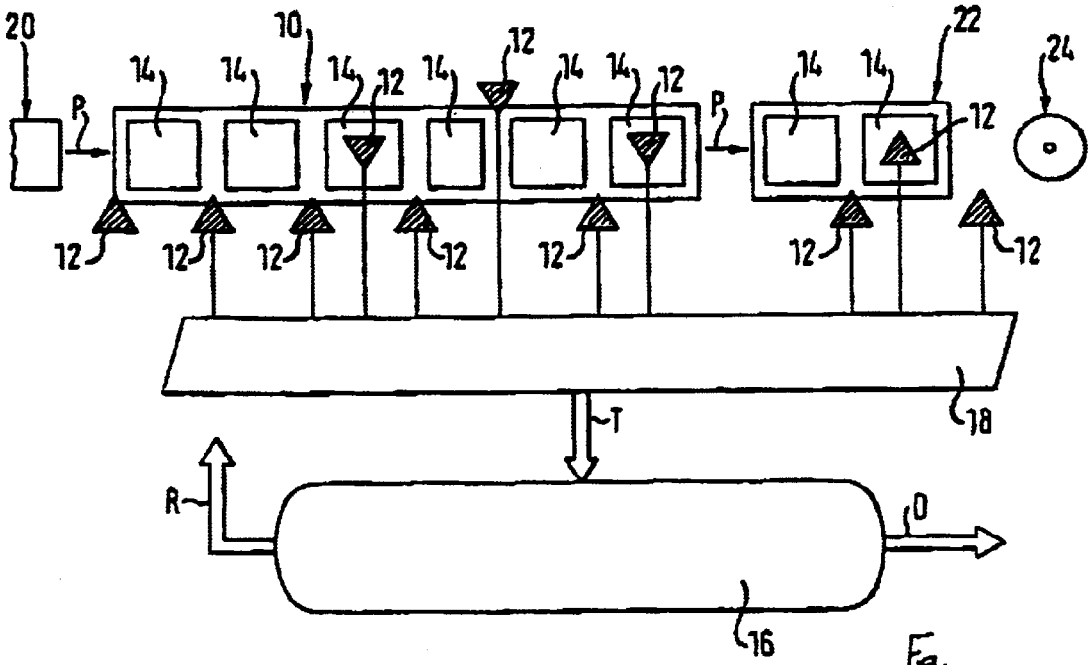
Fig.

METHOD OF OPERATING A MACHINE FOR THE MANUFACTURE AND/OR REFINEMENT OF MATERIAL WEBS

CROSS-REFERENCE TO RELATED APPLICATIONS

The present application is a National Stage Application of International Application No. PCT/EP00/02198, filed Mar. 13, 2000. Further, the present application claims priority under 35 U.S.C. §119 of German Patent Application No. 199 11 394.7 filed on Mar. 15, 1999.

BACKGROUND OF THE INVENTION

1. Field of the Invention

The invention relates to a method for the operation of a machine for the manufacture and/or refinement of material webs, in particular paper webs. The invention also relates to a measurement system for the carrying out of such a method.

2. Discussion of Background Information

Such machines, for example paper making machines, consist of a plurality of different machine sections of which at least some are in turn subdivided into further part sections. Each machine section or part section influences the quality of the finished product, for example of a paper web. It is possible to influence the manufacturing process by appropriate control and regulation of individual machine components forming the respective machine section or part section. The large number of possibilities of adjustment makes it difficult to determine the influence of changes which are made at individual machine components on the ability of the respective machine section or part section to function or on the quality of the finished product.

It is known to carry out moisture content, thickness and weight per unit area measurements following the dryer section of a paper making machine, for example before the roller, and to use these measurements for the control, regulation and optimisation of the process control. It is known, simply for the determination of the moisture content of the paper, to carry out measurements at the start of the dryer section, continuously, regularly—i.e. taking place at specific or process-dependent intervals—or in the short term. Furthermore it is known to carry out continuous, regular or short-term measurements in the steam system and condensate system of the dryer section and to use these measurements for the control and regulation of the process, with the pumps and switch-off valves simply being controlled in the main steam line which leads to the dryer section.

Known apparatuses and methods are for example described in "Das Papier" (The Paper) no. 12, 1995, p.771–775, in "TAPPI Proceedings 1992 Engineering Conference", p.629–638 and also p.639–654 and in "Pulp & Paper Canada", 98:12(1977), p.111–113. A measuring system for the determination of the moisture content of a fibre material web is known from the German patent application 19844927.5 with the filing date Sep. 30, 1998, in which the measurement takes place where the fibre web lies on a substantially water-free, co-moving surface. A known apparatus for the measurement of, for example, the moisture content of a paper web is the instrument "INFRAGAUGE PRO" of the company Infrared Engineering.

SUMMARY OF THE INVENTION

The invention therefore provides a method and also a measuring system of the initially named kind with which a picture can be obtained of the manufacturing process as accurately as possible, in particular in a paper making machine, and which in particular enables changes to be made in the manufacturing process for its optimization or change in targeted manner.

The invention provides that process data concerning at least one measured parameter which relates to a manufacturing process is detected and jointly evaluated in the region of at least one machine section, in particular of the dryer section of a paper making machine, with the detection of the process data taking place at a plurality of measurement zones which are arranged in series in the process direction.

The invention makes it possible to obtain many pieces of information concerning the manufacturing process, at least with respect to the respective machine section. In this way, a substantially more accurate picture of the process or process section results which enables a better understanding of the influence of the individual machine components on the manufacturing process in a complex machine, such as, for example, in a paper making machine. The provision of a plurality of measurement zones arranged in series, which can each include several individual measurement positions, makes it possible to obtain information from such positions of the machine through which the material web moves in time sequence. Thus, for example, by measuring the moisture content of a paper web moving through a dryer section of a paper making machine, the time-dependent course of drying, and thus the influence of the individual components of the dryer section on the paper web can be investigated in detail. The joint evaluation of the process data deleted at the individual measurement zones arranged in series enables an integrated consideration of all measurements and serves in this manner for an improved understanding of the respective machine section. By taking account of the web speed or process speed, individual points on the material path can be followed on their route through the respective machine section. The time-dependent course of the respectively investigated measured parameter can thus be found with a high accuracy. By providing a large number of measurement zones arranged in series and/or by interpolation between the individual process data obtained at measurement zones spaced apart in the process direction it is thus possible to obtain continuous or quasi continuous longitudinal profiles of the respective measured parameter. Furthermore, the process data found in accordance with the invention can be used for the formation and/or the optimisation of mathematical models which at least describe the respective machine section. Since, in accordance with the invention, the respective measured parameter can be obtained spatially resolved in the process direction, as a result of the measured zones being arranged in series, disturbances, for example as a result of defective machine components, for example of a dryer cylinder, can be precisely localised. This enables faults to be overcome considerably more quickly.

In accordance with a preferred embodiment of the invention, the detection of process data takes place at least substantially simultaneously with respect to at least some measurement zones.

In this way, a large quantity of data is simultaneously available concerning different zones of the machine so that the data can be simultaneously evaluated directly following its detection. Through the use of fast computers, rapid on-line control or regulation of the machine can be carried out on the basis of established data.

In accordance with a further preferred embodiment of the invention, the detection of process data takes place in the vicinity of part sections in which machine settings can be changed, in particular by control and/or regulation of machine components.

Thus, by way of example, a measurement zone or a measurement position can be provided directly after a dryer system or of a group of dryer cylinders in the process direction, so that the influence of changes in the settings of the dryer cylinder or cylinders can be read off from the process data and can consequently by recognised at once. By providing a closed regulating circuit, the relevant machine section or part section can as a consequence by ideally set up in the shortest possible time. It is also possible to provide a measurement zone or a measurement location directly before the respective machine section or part section or before a specific machine component, in order to allow the initial conditions prevailing directly in front of this section to enter into the assessment of the respectively investigated section.

In accordance with a further preferred embodiment of the invention, process data are detected concerning a plurality of different measured parameters.

In this way, the manner of operation of the respective machine section or part section can be pictured in a more detailed manner through the process data that is obtained, so that—if necessary—action can be taken in the manufacturing process in a more differentiated manner. The data detection of the different measured parameters preferably also takes place at least substantially simultaneously in order to obtain a fast and accurate overview of the machine with respect to the investigated section or sections.

In a preferred variant, process data concerning measured parameters are detected which relate to the machine, the material web and to the environment.

At least all the important parameters through which the quality of the finished product can influenced in some way or other can be subjected to an integrated consideration and assessment through the joint evaluation of the process data in order to set up the machine in such a way that it is ideally matched to the respectively prevailing conditions with respect to the respectively desired characteristics of the material web.

One measurement parameter can relate to a characteristic paper parameter of a paper web, for example the moisture content, the temperature, the weight per unit area, the thickness, various surface characteristics, the shrinkage behaviour, the air permeability, the extensibility of the paper, the tear length, the load at fracture, the tensile strength, the fibre orientation or the colour. Moreover, damage or a tearing of the paper web can be recognised.

Furthermore, a measured parameter can relate to a characteristic value of a dryer section, and indeed for example to a surface characteristic of the dryer cylinder or of a roll. For this, the surface temperature of the cylinder or of the roll can, for example, come into question.

The measured parameter can also relate to a characteristic value of a steam system and/or condensate system of the dryer section in a paper making machine.

Moreover, a measured parameter can relate to a characteristic value of a screen used in a dryer section. For this purpose, the moisture content, the temperature, the permeability and the degree of contamination of the respective screen come into question. It is also possible to detect damage, deformations, strains and stretching of the screen.

Furthermore, a measured parameter can relate to a characteristic value of the air, for example its temperature or moisture content, or to an airflow, for example its direction or speed, in the region of the respectively investigated machine section or part section.

The process data are preferably detected at least substantially uninterruptedly.

In this way a continuous monitoring and assessment of the manufacturing process is made possible which enables action to be taken at once in a manufacturing process, for example when faults arise.

The measurements take place in each measured zone with at least one measurement device which is either directly attached to the machine or to a frame or beam close to the machine. For the detection of data at a plurality of measurement locations within a measurement zone using a single measurement device, the latter can be movable relative to the machine or to the frame or beam.

The measurement device can, for example, be linearly movable or can generally have a plurality of degrees of freedom, each corresponding to a linear or rotary movement, in order to detect process data concerning a plurality of individual measurement locations in a measurement zone associated with it.

The uninterrupted or continuous detection of data enables a continuous control and/or regulation of machine components in dependence on the process data, with it also being possible to act on individual machine components independently of one another. For this purpose, the process data can be supplied to an evaluation unit which monitors the manufacturing process and optionally acts on the machine components. On-line influencing of the machine or of the manufacturing process makes it possible to react at once to unpredictable changes or intended changes between different types of process, in particular for carrying out type changes of paper making machines by appropriate control or regulation of the respective machine components. Fast changes of type are in particular made possible by the invention.

In accordance with the invention the data detection can also take place at regular or irregular time intervals, in order, for example, to be able to carry out routine checks of the total machine or of individual machine sections or part sections. It is also possible to effect data detection only then when disturbance arise at the machine, in order, for example, to localise the source of disturbance by detection of the process data at measurement zones or measurement points arranged in series in the process direction. For this purpose at least one mobile measurement device can be provided which is installed to carry out the method of the invention in sequence at the individual measurement zones or measurement locations. It is fundamentally also possible to simultaneously investigate the machine, the material web and/or the environment at all measurement points or measurement zones using a plurality of such mobile measurement devices.

In accordance with a further preferred embodiment of the invention the process data are stored in a process data bank.

The knowledge obtained concerning the respective manufacturing process or process section are in this manner not lost and can be made available to interested circles. Furthermore, external access to such banks of process data is possible, for example via the Internet, whereby remote diagnosis by the machine manufacturer is, for example, possible. Moreover, remote control or regulation of the machine or of the manufacturing process can take place from any desired location on the basis of the information which is stored in the data bank and which can be called up.

Furthermore, it is preferred when the process data can be detected in a reflection measurement process. For this, it is not necessary to use through-radiating processes to carry out measurements at the material web, which require a free run of the material web, so that the transmitter and receiver can be arranged at different sides of the material web. Measurements made using refraction methods in which the transmitter and receiver are arranged on the same side of the web do not require free runs and can also be carried out at very high web speeds in which free runs can no longer be realised. In accordance with the invention the process data relating to the material web can in each case be detected in a zone in which the material web is guided or supported, for example by a dryer screen, a roll or a cylinder.

The invention makes it possible to check and/or to regulate the longitudinal profile and/or the course of drying of the material web. This can take place by regulation of the heating curve of the drying section and/or of the individual dryer groups, dryers or humidifiers. This regulation can be effected in one or more part sections. The regulation preferably takes place continuously.

A preferred use of the invention are moisture content measurements along the dryer section. On the basis of the measured moisture content of the material web, i.e. by measuring web humidity, its transverse humidity profile, its longitudinal humidity profile and/or its drying progress can be regulated. This can, for example, takes place by regulation of the heating curve of the dryer section and/or by regulating of the individual dryer groups, dryers and/or humidifiers.

The invention also provides for a measurement system for carrying out the method of the invention which has at least one measurement device for the detection of process data relating to at least one measured parameter at at least one measurement point and also an evaluation unit for the joint evaluation of the process data.

The measurement system preferably includes at least one measurement device which is formed for the detection of process data at a plurality of measurement locations and for this purpose has at least two degrees of freedom, each corresponding to a rotary movement or to a linear movement, or which is rotatable about an axis. Process data can be detected at many measurement points in a short time with a single movable measurement device of this kind.

When, in accordance with a preferred variant, the measurement device is movable approximately perpendicular to the direction of web movement, machine direction or process direction for the measurement of transverse profiles of the respective measured parameter, it is possible to simultaneously obtain a plurality of transverse profiles and longitudinal profiles of the respective measured parameter by providing a plurality of such measurement devices in series in the process direction.

The invention also provides for a method of operating a machine for manufacturing and/or refining a material web wherein the machine includes at least one machine section, the method comprising arranging a plurality of measurement zones in series along a process direction, and detecting data in a region of the at least one machine section via at least one measurement zone of the plurality of measurement zones, wherein the data concerns at least one measured parameter relating to the manufacture or refinement of the material web.

The material web may be a paper web. The at least one machine section may be a drying section. The detecting may comprise detecting data at each of the plurality of measurement zones. The detecting may comprise detecting data at at least two measurement zones of the plurality of measurement zones. The detecting may comprise substantially simultaneously detecting data at the at least two measurement zones. The at least one machine section may comprise a plurality of part sections. The detecting may comprise detecting data in a region of at least one part section of the plurality of part sections. The method may further comprise changing a machine setting of at least one machine component of the at least one machine section. The method may further comprise controlling or regulating a machine setting of at least one machine component of the at least one machine section.

The data may relate to at least one of the at least one machine section, the material web and to an environment of the material web or the at least one machine section. The data may relate to the material web and comprise at least one of a moisture of the material web, a temperature of the material web, a thickness of the material web, and a weight per unit area of the material web. The data may relate to the at least one machine section and comprises at least one of a characteristic value of a surface of the at least one machine section. The surface may comprise a roll or cylinder surface and wherein the characteristic value comprises a temperature. The at least one machine section may comprise at least one of a steam system and a condensate system and wherein the data relates to a characteristic value of the steam system or condensate system. The at least one machine section may comprise a screen and wherein the data relates to a characteristic value of the screen. The characteristic value may comprise at least one of a temperature, a moisture content, and a permeability of the screen.

The data may relate to at least one a characteristic value of an environment of the at least one machine section. The characteristic value of the environment may comprise at least one of an air temperature, an air moisture content, an airflow speed, and an airflow direction. The detecting may comprise detecting data at at least two measurement zones of the plurality of measurement zones, the detecting of the at least two measurement zones occurring substantially uninterruptedly. The detecting may comprise detecting data at at least two measurement zones of the plurality of measurement zones, the detecting of the at least two measurement zones occurring at regular time intervals.

The method may further comprise supplying the data to an evaluation unit. The method may further comprise monitoring and/or influencing the manufacture or refinement of the material web using the evaluation unit. The method may further comprise continuously controlling and/or regulating the manufacture or refinement of the material web using the evaluation unit. The at least one machine section may comprise a plurality of machine components, the method further comprising independent controlling and/or regulating each of the plurality of machine components.

The method may further comprise evaluating the data to effect changes in the manufacture or refinement of the material web. The evaluating may comprise determining at least one of a localized disturbance and a faulty machine component of the at least one machine section. The evaluating may comprise creating a model which describes the manufacture or refinement of the material web. The method may further comprise storing the data regarding the manufacture or refinement of the material web. The method may further comprise transmitting the data regarding the manufacture or refinement of the material web to another location. The transmitting may comprise transmitting the data via the Internet. The method may further comprise evaluating the data at the other location to effect changes in the manufacture or refinement of the material web.

The detecting may comprise detecting data using reflection measurement. The method may further comprise at least one of supporting the material web and guiding the material web, wherein the detecting comprises detecting the data in a region of the material web. The method may further comprise at least one of supporting the material web and guiding the material web on at least one of a screen, a cylinder and a roll, wherein the detecting comprises detecting the data in a region of the screen, the cylinder or the roll. The method may further comprise regulating or checking at least one of a longitudinal profile and a course of the material web. The at least one machine section may comprise a dryer section, the method may further comprise regulating or checking at least one of a heating curve of the dryer section. The at least one machine section may comprise a dryer section, and the method may further comprise continuously regulating or checking at least one of a heating curve of the dryer section. The at least one machine section may comprise a dryer section, and the method may further comprise regulating at least one component of the dryer section, wherein the at least one component comprises at least one of an individual dryer group, a dryer, and a humidifier.

The method may further comprise regulating a transverse moisture profile of the material web. The regulating may comprise step-wise regulating the transverse moisture profile of the material web. The data may relate to a measured humidity content and the regulating may comprise step-wise regulating the transverse moisture profile of the material web based upon the measured humidity content. The at least one machine section may comprise a plurality of zone-wise regulatable dryers, and the method may further comprise regulating a transverse moisture profile of the material web. The at least one machine section may comprise a press section having at least one steam blow box, and the method may further comprise regulating a transverse moisture profile of the material web. The method may further comprise regulating a longitudinal moisture profile of the material web. The data may relate to a measured humidity content and wherein the regulating may comprise regulating the longitudinal moisture profile of the material web based upon the measured humidity content.

The invention also provides a measurement system for use in operating a machine for manufacturing and/or refining a material web wherein the machine includes at least one machine section, the system comprising a plurality of measurement zones arranged in series along a process direction of the machine, at least one measurement device for detecting data in a region of the at least one machine section, the at least one device being located in at least one of the plurality of measurement zones, and an evaluation unit for evaluating the data.

The invention further provides a measurement system for use in operating a machine for manufacturing and/or refining a material web wherein the machine includes at least one machine section, the system comprising a plurality of measurement zones arranged in series along a process direction of the machine, at least one of the plurality of measurement zones being located in the at least one machine section, at least one measurement device for detecting data being located in at least one of the plurality of measurement zones, and an evaluation unit for evaluating the data.

The data may concern at least one measured parameter that relates to the manufacture or refinement of the material web. The material web may be a paper web. The at least one machine section may be a drying section. Each of the plurality of measurement zones may include at least one measurement device. At least two measurement zones of the plurality of measurement zones may comprise at least one measurement device. The at least one measurement device may be at least one of rotatable and movable in at least two degrees of freedom. The at least one measurement device may be at least one of rotatably movable and linearly movable. The at least one measurement device may be movable and capable of detecting the data at a plurality of measurement locations. The at least one measurement device may be movable in a direction which is approximately perpendicular to the process direction.

The invention also provides for a measurement system for use in operating a machine for manufacturing and/or refining a material web wherein the machine includes a press section, a dryer section and a refinement section, the system comprising a plurality of measurement zones arranged in series along a process direction of the machine, each of the dryer section and the refinement section including at least two measurement zones, at least one measurement device for detecting data being located in a region of each measurement zone, and an evaluation unit for evaluating the data being coupled to each of the at least one measurement devices, wherein the data concerns at least one measured parameter relating to the manufacture or refinement of the material web.

Further preferred embodiments of the invention are set forth in the claims, in the description and also in the drawing.

BRIEF DESCRIPTION OF THE DRAWINGS

The invention will be described in the following by way of example with reference to a drawing, the single FIGURE of which schematically shows a measurement system used at a paper making machine to carry out the method of the invention in accordance with an embodiment of the invention.

DETAILED DESCRIPTION OF THE INVENTION

In the drawing a part of a paper making machine is shown in which a press section 20, a fryer section, a refinement section 22 and also a roller section 24 follow one another in the process direction P.

The dryer section and the refinement section 22 each include a plurality of part sections 14 which are symbolised by squares. In the dryer section 10 the part sections 14 can, for example, be individual dryer cylinders, groups of dryer cylinders or generally different drying systems.

Individual measurement zones 12 at which process data relating to at least one measured parameter is detected with at least one (not illustrated) measurement device are shown in the FIGURE by hatched triangles.

One measurement device having a plurality of degrees of freedom and in particular being movable in at least one longitudinal direction, for example the machine direction, the transverse direction or the vertical direction, and also pivotable or rotatable via a joint in at least one plane is preferably provided in each measurement zone 12. One measurement zone 12 can thus be covered by a single measurement device in which the paper web, a machine component and the environment can be investigated at a plurality of individual measurement points In the embodiment shown in the FIGURE, the first three measurement zones 12 and also the fifth and seventh measurement zone 12 in the process direction are arranged beneath the respective part section 14 of the respectively machine components of the dryer section 10. The fourth and also the last measurement zone 12 are each located within a part section 14 of the dryer section 10 and can each, for example, be reached with a measurement device which is mounted at the free end of a beam which projects into the dryer section 10, for example into the intermediate space between the individual dryer cylinders. The sixth measurement zone 12 in the process direction P is located above the dryer section 10, with it being possible for the measurement device provided for carrying out the measurements at this measurement zone 12, to be mounted on a beam or frame which extends over the dryer section in the manner of a hall crane.

Each measurement device includes at least one measurement head which is designed for the detection of data relating to one measured parameter. The measurement can be carried out either at the paper making machine, at the paper web or in the environment.

In this connection some of the measurement zones 12 provided in series in the process direction P can each be provided for the measurement of the same measured parameter, for example the moisture content of the paper web, in order, in this way, to obtain a longitudinal profile of this measured parameter. Furthermore, different measurement parameters can be measured at each measurement zone 12 either with the aid of a plurality of different measurement devices or of a plurality of differently designed measurement heads which are combined to one unit or measurement device. In this manner, measurements at the paper web, at the paper making machine or in the environment can be made at each measurement zone 12.

The same also applies to the refining section 22 at which two measurement zones 12 are provided in the illustrated embodiment, with the first measurement zone 12 in the process direction P being arranged beneath the refinement section 22 and the second measurement zone 12 being located within the rear one of the two part sections 14.

The measurement zones 12 located beneath and above the dryer section 10 and also the refinement section 22 are each located directly in front of or behind a part section 14 in the process direction P.

As indicated in the FIGURE by the arrows emerging from the measurement zones 12, the process data are supplied to a common detection unit 18 which communicates with the measurement devices arranged in the measurement zones 12.

The process data are transferred from the detection unit 18 to a common evaluation unit 16 as is indicated in the FIGURE by the arrow T. In the evaluation unit 16 a joint evaluation of the process data takes place in which additional parameters, such as, for example, the process speed, can also be taken into account in order to obtain, through the integrated consideration of the process data and eventually of the additional data, a picture of the state of the dryer section 10 and of the refining section 22 and also of their influence on the paper web and thus on the manufacturing process.

The detection and evaluation of the process data preferably takes place uninterruptedly in order to enable a continuous monitoring and assessment of the paper making machine or of the dryer section 10 and refining section 22. The evaluation unit 16 can be provided with a computer on which software is installed for the modelling of the manufacturing process or of the processes which take place in the dryer section 10 and in the refining section 22. The process data which reflect the actual conditions at the paper making machine can be used for the checking and optimisation of such models. In particular, when the machine is to be controlled or regulated on the basis of such models, the checking and adaptation of the models takes place in dependence on the actual process data on-line in order to realise a continuous influencing of the machine while taking account of the process data.

On the basis of the detected process data and/or of the initial data of process models, a control and/or regulation of individual machine components in the dryer section 10 and in the refining section 22 takes place, if necessary, through the evaluation unit 16, as indicated by the arrow R in the drawing. Machine components at other sections of the paper making machine at which no data which enters into the integrated consideration is detected can basically also be acted on via the evaluation unit 16.

Furthermore, the possibility exists, in accordance with the invention, of a data transfer indicated in the FIGURE by the arrow D to a databank for the storage of process data or via, data lines, for example utilising the Internet, to external receivers. In this manner, a remote diagnosis and also remote control or regulation of the paper making machine can, for example, take place by the machine manufacturer.

What is claimed is:

1. A method of operating a machine for manufacturing and/or refining a material web wherein the machine includes at least one machine section, the method comprising:

arranging a plurality of measurement zones in series along a process direction; and detecting data in each of the plurality of measurement zones using at least one measurement device that detects the data while moving along at least two degrees of freedom of movement, wherein the data concerns at least one measured parameter relating to the manufacture or refinement of the material web.

2. The method of claim 1, wherein the material web is a paper web.

3. The method of claim 1, wherein the at least one machine section is a drying section and wherein each of the plurality of measurement zones is arranged in different part section of the dryer section.

4. The method of claim 1, wherein the detecting comprises detecting the data at each of the plurality of measurement zones at regular time intervals.

5. The method of claim 1, wherein the detecting comprises detecting the data at at least three measurement zones.

6. The method of claim 1, wherein the detecting comprises substantially simultaneously detecting the data at each of the plurality of measurement zones.

7. The method of claim 1, wherein the at least one machine section comprises a plurality of part sections and wherein each of the plurality of measurement zones is arranged at least one of within different part section and between different part sections.

8. The method of claim 1, wherein the at least one machine section comprises different machine sections and wherein the detecting comprises detecting the data in at least one part section of each of the different machine sections.

9. The method of claim 1, further comprising changing a machine setting of at least one machine component of the at least one machine section.

10. The method of claim 1, further comprising controlling or regulating a machine setting of at least one machine component of the at least one machine section.

11. The method of claim 1, wherein the data relates to at least one of the at least one machine section, the material web and to an environment of the material web or the at least one machine section.

12. The method of claim 11, wherein the data relates to the material web and comprises at least one of a moisture of the material web, a temperature of the material web, a thickness of the material web, and a weight per unit area of the material web.

13. The method of claim 11, wherein the data relates to the at least one machine section and comprises a characteristic value of a surface of the at least one machine section.

14. The method of claim 13, wherein the surface comprises a roll or cylinder surface and wherein the characteristic value comprises a temperature.

15. The method of claim 1, wherein the at least one machine section comprises at least one of a steam system and a condensate system and wherein the data relates to a characteristic value of the steam system or condensate system.

16. The method of claim 1, wherein the at least one machine section comprises a screen and wherein the data relates to a characteristic value of the screen.

17. The method of claim 16, wherein the characteristic value comprises at least one of a temperature, a moisture content, and a permeability of the screen.

18. The method of claim 1, wherein the data relates to at least one a characteristic value of an environment of the at least one machine section.

19. The method of claim 18, wherein the characteristic value of the environment comprises at least one of an air temperature, an air moisture content, an airflow speed, and an airflow direction.

20. The method of claim 1, wherein the detecting comprises detecting one type of data at one of the plurality of measurement zones and detecting another type of data at another of the plurality of measurement zones, the detecting occurring substantially uninterruptedly.

21. The method of claim 1, wherein the detecting comprises detecting one type of data at one of the plurality of measurement zones and detecting another type of data at another of the plurality of measurement zones, the detecting occurring at regular time intervals.

22. The method of claim 1, further comprising supplying the data to an evaluation unit.

23. The method of claim 22, further comprising monitoring and/or influencing the manufacture or refinement of the material web using the evaluation unit.

24. The method of claim 22, further comprising continuously controlling and/or regulating the manufacture or refinement of the material web using the evaluation unit.

25. The method of claim 22, wherein the at least one machine section comprises a plurality of machine components, the method further comprising independent controlling and/or regulating each of the plurality of machine components.

26. The method of claim 1, further comprising evaluating the data to effect changes in the manufacture or refinement of the material web.

27. The method of claim 26, wherein the evaluating comprises determine at least one of a localized disturbance and a faulty machine component of the at least one machine section.

28. The method of claim 26, wherein the evaluating comprises creating a model which describes the manufacture or refinement of the material web.

29. The method of claim 1, further comprising storing the data regarding the manufacture or refinement of the material web.

30. The method of claim 1, further comprising transmitting the data regarding the manufacture or refinement of the material web to another location.

31. The method of claim 30, wherein the transmitting comprises transmitting the data via the Internet.

32. The method of claim 30, further comprising evaluating the data at the other location to effect changes in the manufacture or refinement of the material web.

33. The method of claim 1, wherein the detecting comprises detecting data using reflection measurement.

34. The method of claim 1, further comprising at least one of supporting the material web and guiding the material web, wherein the detecting comprises detecting the data in a region of the material web.

35. The method of claim 1, further comprising at least one of supporting the material web and guiding the material web on at least one of a screen, a cylinder and a roll, wherein the detecting comprises detecting the data in a region of the screen, the cylinder or the roll.

36. The method of claim 1, further comprising regulating or checking at least one of a longitudinal profile and a course of the material web.

37. The method of claim 1, wherein the at least one machine section comprises a dryer section, the method further comprising regulating or checking at least one of a heating curve of the dryer section.

38. The method of claim 1, wherein the at least one machine section comprises a dryer section, the method further comprising continuously regulating or checking at least one of a heating curve of the dryer section.

39. The method of claim 1, wherein the at least one machine section comprises a dryer section, the method further comprising regulating at least one component of the dryer section, wherein the at least one component comprises at least one of an individual dryer group, a dryer, and a humidifier.

40. The method of claim 1, further comprising regulating a transverse moisture profile of the material web.

41. The method of claim 40, wherein the regulating comprises regulating step-wise the transverse moisture profile of the material web.

42. The method of claim 40, wherein the data relates to a measured humidity content and wherein regulating comprise step-wise regulating the transverse moisture profile of the material web based upon the measured humidity content.

43. The method of claim 1, wherein the at least one machine section comprises a plurality of zone-wise regulatable dryers, the method further comprising regulating a transverse moisture profile of the material web.

44. The method of claim 1, wherein the at least one machine section comprises a press section having at least one steam blow box, the method further comprising regulating a transverse moisture profile of the material web.

45. The method of claim 1, further comprising regulating a longitudinal moisture profile of the material web.

46. The method of claim 45, wherein the data relates to a measured humidity content and wherein regulating comprise regulating the longitudinal moisture profile of the material web based upon the measured humidity content.

47. A measurement system for use in operating a method for manufacturing and/or refining a material web wherein the machine includes at least one machine section, the system comprising:

a plurality of measurement zones arranged in series along a process direction of the machine;

at least one of the plurality of measurement zones being located in the at least one machine section;

at least one measurement device for detecting data being located in each of the plurality of measurement zones; and each of the measurement devices detecting the data while moving along at least two degrees of freedom of movement; and an evaluation unit for evaluating the data.

48. The system of claim 47, wherein the data concerns at least one measured parameter that relates to the manufacture or refinement of the material web.

49. The system of claim 47, wherein the material web is a paper web.

50. The system of claim 47, wherein the at least one machine section is a drying section.

51. The system of claim 47, wherein each of the plurality of measurement zones is arranged in different part sections of the at least one machine section.

52. The system of claim 47, wherein at least three measurement zones of the plurality of measurement zones include at least one measurement device.

53. The system of claim 47, wherein at least one of the measurement devices is rotatable and movable in the process direction and transverse to the process direction.

54. The system of claim 47, wherein at least one of the measurement devices is rotatably movable and linearly movable.

55. The system of claim 47, wherein at least one of the measurement devices is capable of detecting the data at a plurality of measurement locations.

56. The system of claim 47, wherein at least one of the measurement devices is movable in a direction which is approximately perpendicular to the process direction.

57. A measurement system for use in operating a machine for manufacturing and/or refining a material web wherein the machine includes a press section, a dryer section and a refinement section, the system comprising:

a plurality of measurement zones arranged in series along a process direction of the machine;

each of the dryer section and the refinement section including at least two measurement zones;

at least one measurement device for detecting data being located in a region of each measurement zone; and each of the measurement devices detecting the data while moving along at least two degrees of freedom of movement; and an evaluation unit for evaluating the data being coupled to each of the measurement devices, wherein the data concerns at least one measured parameter relating to the manufacture or refinement of the material web.

* * * * *